US010482809B2

(12) United States Patent
Xu et al.

(10) Patent No.: US 10,482,809 B2
(45) Date of Patent: Nov. 19, 2019

(54) LED DISPLAY SCREEN CAPABLE OF IMPLEMENTING A VARIETY OF ASSEMBLING MODES

(71) Applicant: Shenzhen Dicolor Optoelectronics Co., Ltd., Shenzhen (CN)

(72) Inventors: Chenai Xu, Shenzhen (CN); Mingjin Wu, Shenzhen (CN); Gang Yu, Shenzhen (CN); Hanchun Liu, Shenzhen (CN); Zhichun Tian, Shenzhen (CN); Lin Zhang, Shenzhen (CN)

(73) Assignee: SHENZHEN DICOLOR OPTOELECTRONICS CO., LTD., Shenzhen (CN)

( * ) Notice: Subject to any disclaimer, the term of this patent is extended or adjusted under 35 U.S.C. 154(b) by 179 days.

(21) Appl. No.: 15/744,835

(22) PCT Filed: Jun. 29, 2017

(86) PCT No.: PCT/CN2017/090799
§ 371 (c)(1),
(2) Date: Jan. 15, 2018

(87) PCT Pub. No.: WO2018/157532
PCT Pub. Date: Sep. 7, 2018

(65) Prior Publication Data

US 2019/0012955 A1 Jan. 10, 2019

(30) Foreign Application Priority Data

Mar. 1, 2017 (CN) ..... 2017 1 0115799

(51) Int. Cl.
*G09F 9/33* (2006.01)
*G09G 3/32* (2016.01)
*G09F 13/04* (2006.01)

(52) U.S. Cl.
CPC ..... *G09G 3/32* (2013.01); *G09F 9/33* (2013.01); *G09F 13/0413* (2013.01); *G09G 2300/04* (2013.01)

(58) Field of Classification Search
CPC ..... G02F 1/333; G02F 2001/13334; A47B 81/06–065; G09G 2300/04;
(Continued)

(56) References Cited

U.S. PATENT DOCUMENTS 1,877,172 A * 9/1932 Harris ..... G09F 9/37 40/463
2015/0282344 A1* 10/2015 Ho ..... F16M 11/045 248/125.7

FOREIGN PATENT DOCUMENTS

CN 204010566 U 12/2014
CN 204496859 U 7/2015
(Continued)

*Primary Examiner* — Anabel Ton
(74) *Attorney, Agent, or Firm* — Gokalp Bayramoglu

(57) ABSTRACT

An LED display screen having two or more frames each including a left and a right side plate. An oblique boss is disposed on left end surface of the left side plate. A through-hole extending left-and-right is defined in the right side plate. A front side plate and a rear enclosure plate are respectively disposed on front and rear sides and enclose a space communicated with the through-hole. An arc-shaped locking mechanism disposed on the right side of the frame includes a rotating block between the front side plate and rear enclosure plate; a knob outside the front end of the front side plate and fixedly connected to the rotating block; and multiple differently inclined plates on the outer ring of the rotating block. The oblique boss of one frame is operative to abut against different inclined plates of an adjacent frame, respectively.

19 Claims, 10 Drawing Sheets

(58) Field of Classification Search
CPC ..... H04N 5/64–655; Y10T 29/1039; Y10T 29/1043; Y10T 29/1075; Y10T 29/1078; Y10T 29/0863; Y10T 29/0886; Y10T 29/089; G09F 9/3023; G09F 9/33; G09F 9/373026
USPC ..... 348/787, 789, 794, 836, 843; 248/220.22, 917
See application file for complete search history.

(56) References Cited

FOREIGN PATENT DOCUMENTS

| | | | |
|---|---|---|---|
| CN | 204533998 | U | 8/2015 |
| CN | 106448483 | A | 2/2017 |
| CN | 106683581 | A | 5/2017 |

* cited by examiner

LED DISPLAY SCREEN CAPABLE OF IMPLEMENTING A VARIETY OF ASSEMBLING MODES

CROSS REFERENCE TO RELATED APPLICATIONS

This application is the national phase entry of International Application No. PCT/CN2017/090799, filed on Jun. 29, 2017, which claims priority from the Chinese patent application no. 2017101157992 filed on Mar. 1, 2017, the entire contents of which are incorporated herein by reference.

TECHNICAL FIELD

This disclosure relates generally to LED display screens, and more particularly relates to an LED display screen capable of implementing a variety of assembling modes.

BACKGROUND

LED display technology continues to develop and has found increasingly wide applications. The LED display industry is developing towards high-density, multi-shape, and ease of installation.

High-density indicates large screens are demanded, while multi-shape means the shape of the entire LED display screen is desired to be variable to meet actual needs. Because large-screen LED displays are not easy to transport, the typical solution is assembling a plurality of smaller LED display screens into a large-screen LED display. Each smaller LED display screen includes a frame and an LED display module installed at one side of the frame, so that a number of these frames can be assembled together for a variety of assembling purposes.

But most of the plurality of frames lie in the same plane after they are assembled; that is, these frames are assembled to create a flat surface. There are also frames assembled to form a certain angle so that the entire LED display screen is a curved shape. Existing frame structure, however, can either be assembled into a planar configuration or be assembled into a shape having a certain angle which can only be a fixed angle. Thus, the compatibility between the planar configuration and the angular configuration cannot be attained, not to mention achieving assembled configurations having different angles. Which means it is impossible to achieve a variety of assembling modes, so that the frame is not universal and frames of different structures would be required for assembling LED display screens of different shapes, which would greatly increase the cost.

SUMMARY

It is therefore one of various objects of this disclosure to overcome the above shortcomings by providing an LED display that is capable of implementing a variety of assembling modes.

To achieve the above-mentioned object, the following technical solution is adopted by this disclosure.

An LED display screen capable of implementing a variety of assembling modes is provided. The LED display screen includes two or more frames each including a left side plate and a right side plate. An oblique boss is disposed on a left end surface of the left side plate. A through hole extending leftward and rightward is defined in the right side plate. A front side plate and a rear enclosure plate are respectively disposed on the front and rear sides to the left of the right side plate, and the space between the front side plate and the rear enclosure plate is communicated with the through hole. An arc-shaped locking mechanism is disposed on the right side of the frame and includes a rotating block and a knob that are fixedly connected. The rotating block is disposed between the front side plate and the rear enclosure plate, while the knob is disposed outside the front end of the front side plate. A plurality of inclined plates having different tilt angles is disposed on the outer ring of the rotating block. The oblique boss of one of the frames is operative to stick with and abut against different inclined plates of the rotating block of an adjacent frame respectively. The LED display screen capable of implementing a variety of assembling modes may further include a quick locking mechanism configured to firmly connect two adjacent frames.

In some embodiments, a through hole extending leftward and rightward is defined in the left side plate of the frame and penetrates through the oblique boss. An inverted double-D-shaped lock hole is defined in the middle of each of the plurality of inclined plates of the rotating block. The quick locking mechanism includes a sleeve and a lock lever that extend leftward and rightward, and a handle fixedly connected to the right end of the lock lever. The sleeve is fixedly connected within the through hole. The lock lever is inserted through the sleeve and threadedly connected to the sleeve. The handle is disposed on the right side of the left side plate. An inverted double-D-shaped lock head corresponding to the shape of the inverted double-D-shaped lock hole is disposed at the left end of the lock lever, the inverted double-D-shaped lock head is operative to insert through the inverted double-D-shaped lock hole in each of the plurality of inclined plates of the rotating block of the adjacent frame into the rotating block of the adjacent frame.

In some embodiments, an angle indicator point is provided on the knob. Correspondingly, a circle of angular digital marks is provided on the front side plate around the knob.

In some embodiments, the arc-shaped locking mechanism further includes a rotating shaft. An upper end of the rotating shaft penetrates through the front plate to be fixedly connected to the middle portion of the knob. A lower side of the rotating shaft is fixedly connected to the rotating block. A circular mating hole is defined in the rear enclosure plate and a corresponding circular limiting step is disposed at the lower end of the rotating shaft. The circular limiting step at the lower end of the rotating shaft passes downward through the rotating block and is relatively rotatably inserted into the circular mating hole.

In some embodiments, the rotating block further includes a middle portion, and a plurality of groups of extension plates extending outwardly from the middle portion. Each group of the plurality of groups of extension plates is arranged as two extension plates spaced apart from each other, and an outer end of each group of the plurality of groups of extension plates is connected to one of the plurality of inclined plates so that there is enclosed a space between the inclined plate, the group of extension plates connected to the inclined plate, and the middle portion of the rotating block. The inverted double-D-shaped lock head is operative to insert through the inverted double-D-shaped lock hole of each of the plurality of inclined plates of the rotating block of the adjacent frame into the rotating block of the adjacent frame or into this enclosed space.

In some embodiments, the front end surface of the middle portion of the rotating block is lower than the front end surface of the extension plates. A protruding post is arranged on the inner end of the front side plate and extends backward from the center of the inner end, so that after the arc-shaped locking mechanism is assembled, the front end surface of the middle portion of the rotating block abuts against the rear end surface of the protruding post, the front end surface of the extension plates abuts against the inner end surface of the front side plate, and the rear end surface of the rotating block is in contact with the inner end surface of the rear enclosure plate.

In some embodiments, connection holes extending forward and backward are defined in both the center of the protruding post and the center of the middle portion of the rotating block. The upper end of the rotating shaft passes upward through the connection hole in the center of the protruding post to be fixedly connected to the knob. The lower end of the rotating shaft inserts downward into the connection hole in the center of the middle portion of the rotating block. The circular limiting step at the lower end of the rotating shaft passes through the connection hole in the center of the middle portion of the rotating block to be inserted into the circular mating hole in the rear enclosure plate. The rotating shaft is fixedly connected with the middle portion of the rotating block.

In some embodiments, the rotating block includes a plurality of inclined plates, a front plate connected to the front end of the plurality of inclined plates, and a rear plate connected to the rear end of the plurality of inclined plates, wherein a hollow space is enclosed between the front plate, the rear plate, and the plurality of inclined plates.

In some embodiments, a first elastic bead is arranged on the upper end surface of the rotating block. Correspondingly, a plurality of first positioning holes corresponding to the number of the inclined plates of the rotating block is defined in the lower end surface of the front side plate in an annular array.

In some embodiments, a second elastic bead is arranged on the oblique boss. Correspondingly, a second positioning hole is arranged on each of the inclined plates of the rotating block and is operative to engage with the second elastic bead and facilitate the positioning.

This disclosure can have the following advantages. Because the rotating block in accordance with the present disclosure is provided with a plurality of inclined plates having different tilt angles, different inclined plates can respectively be engaged with the oblique boss of the other frame so that the two frames will make different angles after they are assembled.

Thus, the frames of the LED display screen according to this disclosure can not only be assembled into a planar configuration but they can also be assembled into angular configurations. That is, the LED display screen in accordance with the present disclosure can not only be assembled as a planar shape, but it can be assembled as a curved shape and can further be assembled into curved shapes with different curvatures with superior assembling effects. In other words, the frames provided by the present disclosure can implement a variety of assembling modes, so that LED display screens of different shapes can be assembled using the frames provided by this disclosure; that is, the frame provided herein has versatility and can thus greatly reduce the cost.

In addition, because the knob is provided with the angle indicator point while the front side plate is provided with the corresponding angular digital marks, in actual assembling the knob needs only to be directly rotated to make the angle indicator point align with the desired angular digital mark, which is particularly intuitive, so that the angle adjustment is particularly simple and convenient, and the operation difficulty in assembling is greatly reduced. Furthermore, the structural arrangement of the quick locking mechanism also makes it easier and faster to lock the two frames together.

DETAILED DESCRIPTION OF THE EMBODIMENTS

Figure 1:
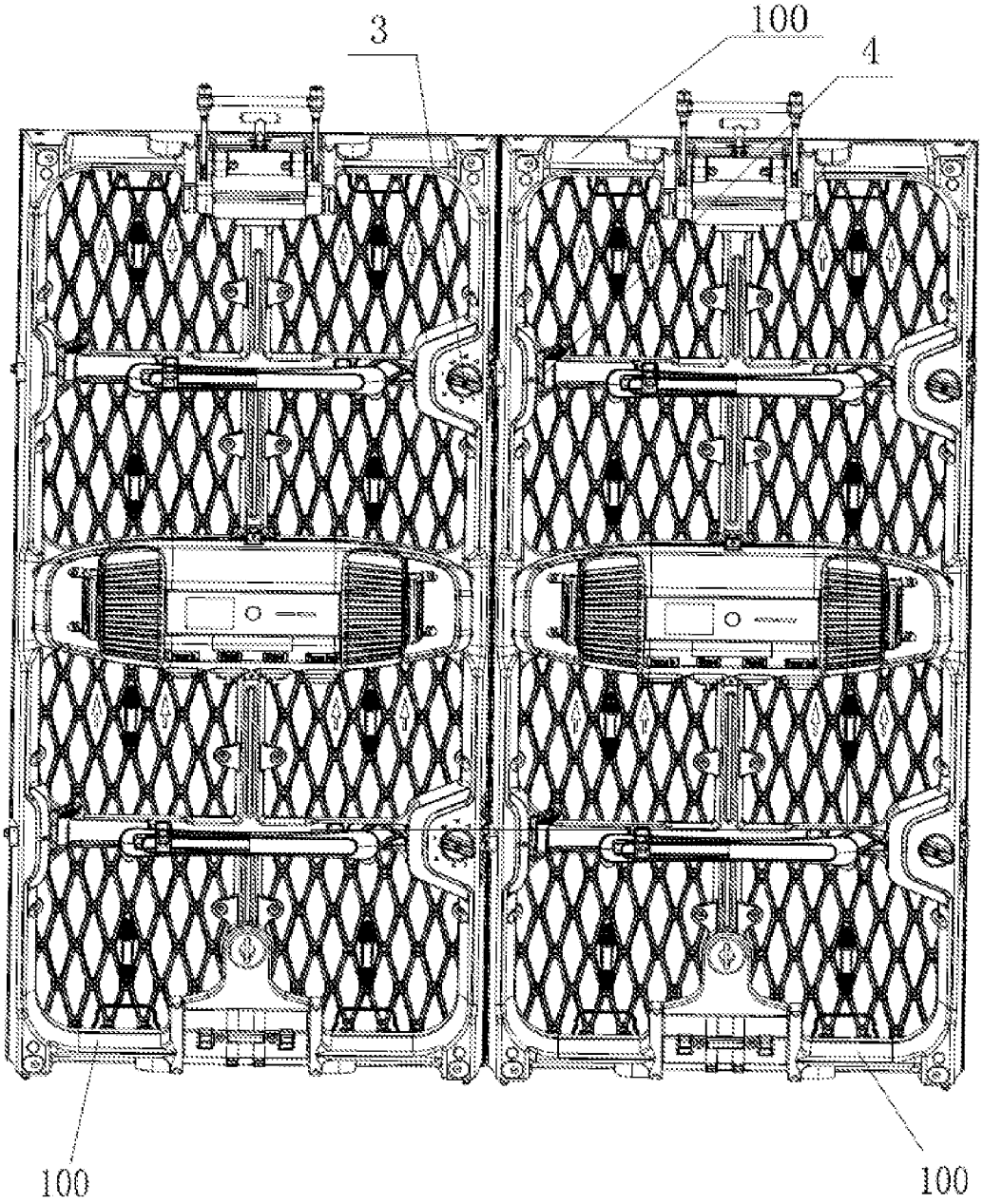
FIG. 1 is a schematic diagram of an LED display screen in accordance with an embodiment of the present disclosure.

As illustrated in FIGS. 1 through 6, an LED display screen capable of implementing a variety of assembling modes in accordance with the present disclosure may include two or more frames 100. Each of the frames 100 includes a left side plate 1 and a right side plate 2. An oblique boss 11 is disposed on the left end surface of the left side plate 1. A through hole 21 is defined in the right side plate 2. A front side plate 22 and a rear enclosure plate 23 are respectively disposed on the front and rear sides to the left of the right side plate 2. The space between the front side plate 22 and the rear enclosure plate 23 is communicated with the through hole 21. An arc-shaped locking mechanism 3 is arranged on the right side of the frame 100 and includes a rotating block 31 and a knob 32 that are fixedly connected to each other. The rotating block 31 is disposed between the front side plate 22 and the rear enclosure plate 23. The knob 32 is disposed outside the front end of the front side plate 22. A plurality of inclined plates 311 having different tilt angles may be arranged on the outer ring of the rotating block 31. The oblique boss 11 of one of the frames 100 is operative to abut against the different inclined plates 311 of the rotating block 31 of an adjacent frame 100, respectively. The LED display screen capable of implementing a variety of assembling modes may further include a quick locking mechanism 4 configured for firmly connecting two adjacent frames 100.

Figure 7:
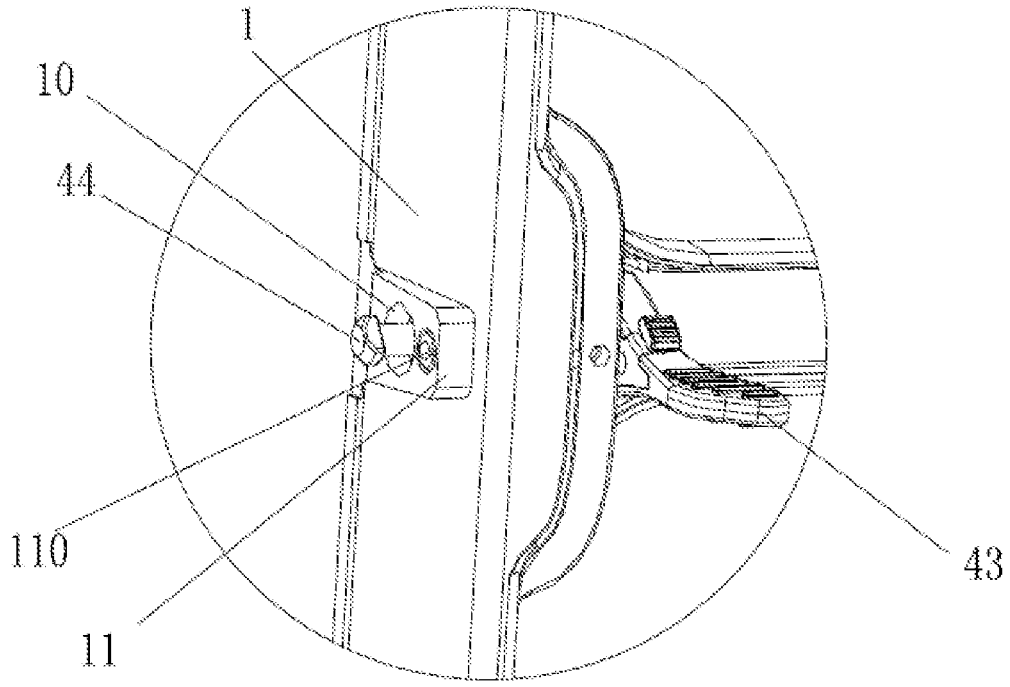
FIG. 7 is an enlarged schematic view of part B of FIG. 2 observed from another perspective.
Figure 8:
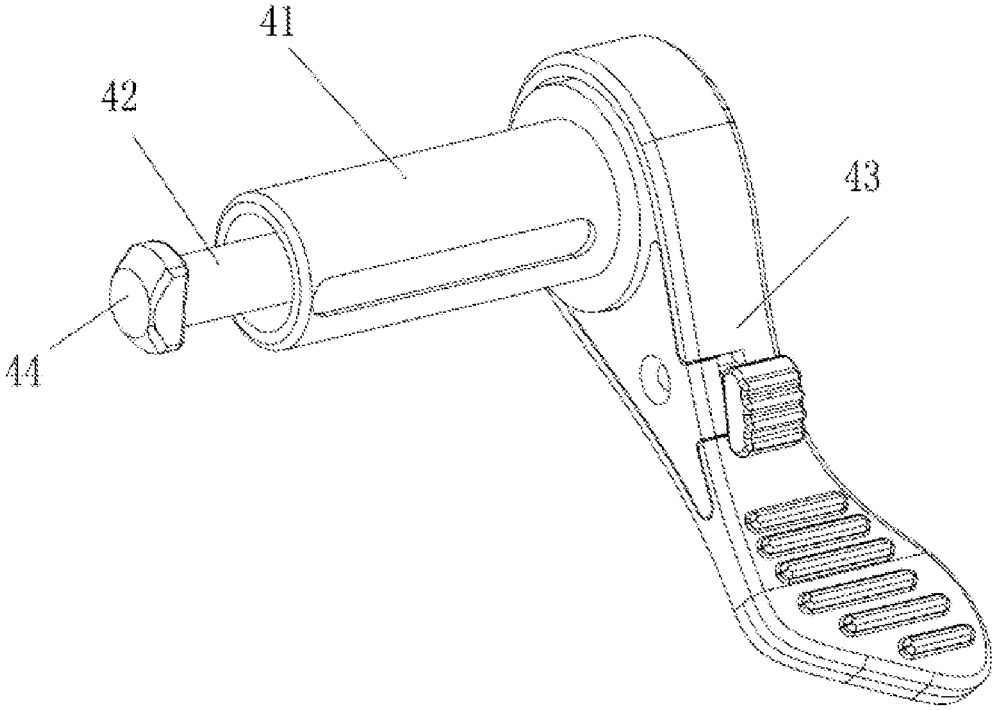
FIG. 8 is an enlarged schematic view of a quick locking mechanism of an LED display screen in accordance with an embodiment of the present disclosure.

In connection also with FIGS. 7 and 8, in some embodiments a through hole 10 extending leftward and rightward is defined in the left side plate 1 of the frame 100. The through hole 10 penetrates through the oblique boss 11. An inverted double-D-shaped lock hole 312 is defined in the middle of each of the plurality of inclined plates 311 of the rotating block 31. The quick locking mechanism 4 includes a sleeve 41 and a lock lever 42 that extend leftward and rightward, and a handle 43 fixedly connected to the right end of the lock lever 42. The sleeve 41 is fixedly connected within the through hole 10. The lock lever 42 is inserted through the sleeve 41 and threadedly connected to the sleeve 41. The handle 43 is disposed on the right side of the left side plate 1. An inverted double-D-shaped lock head 44 corresponding to the shape of the inverted double-D-shaped lock hole 312 is disposed at the left end of the lock lever 42. The inverted double-D-shaped lock head 44 is operative to insert into the rotating block 31 of the adjacent frame 100 via the inverted double-D-shaped lock hole 312 of each of the plurality of inclined plates 311 of the rotating block 31 of the adjacent frame 100.

Figure 5:
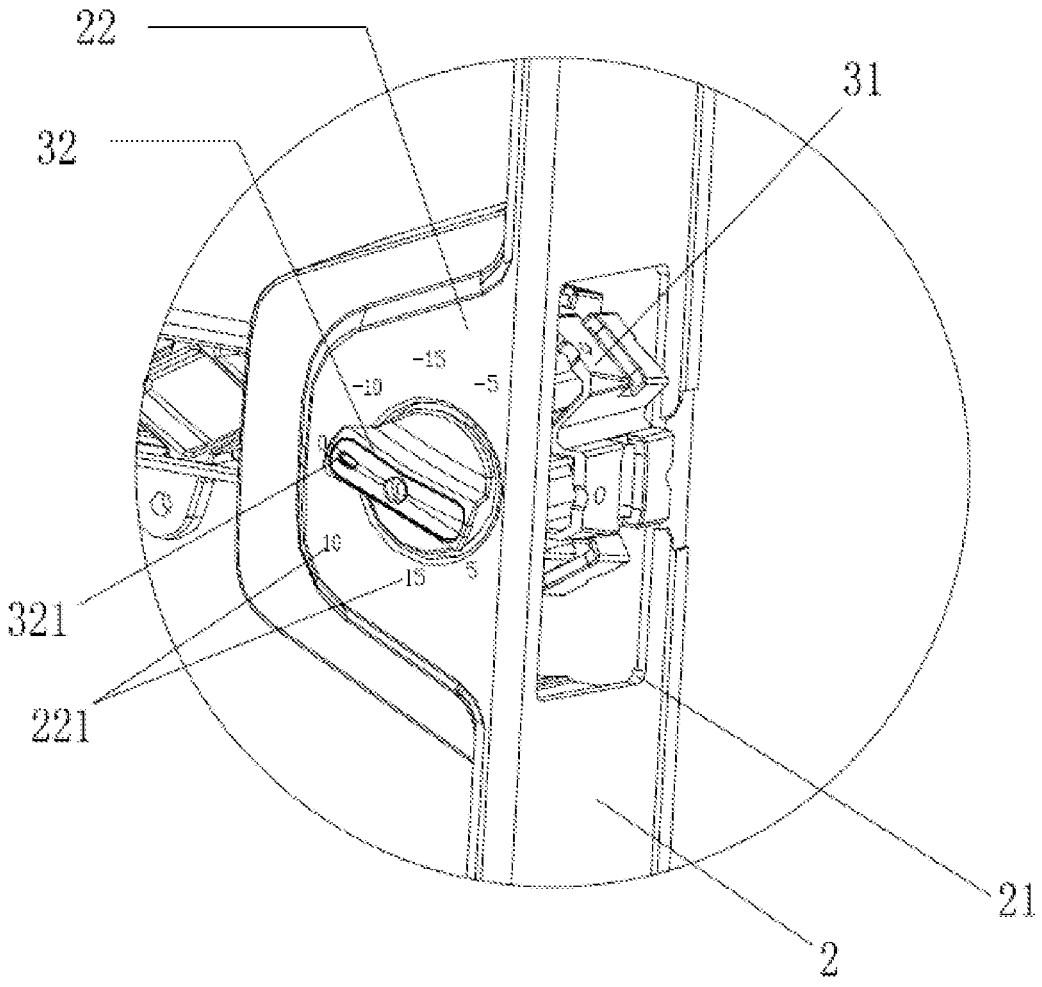
FIG. 5 is an enlarged schematic view of part A of FIG. 2.
Figure 6:
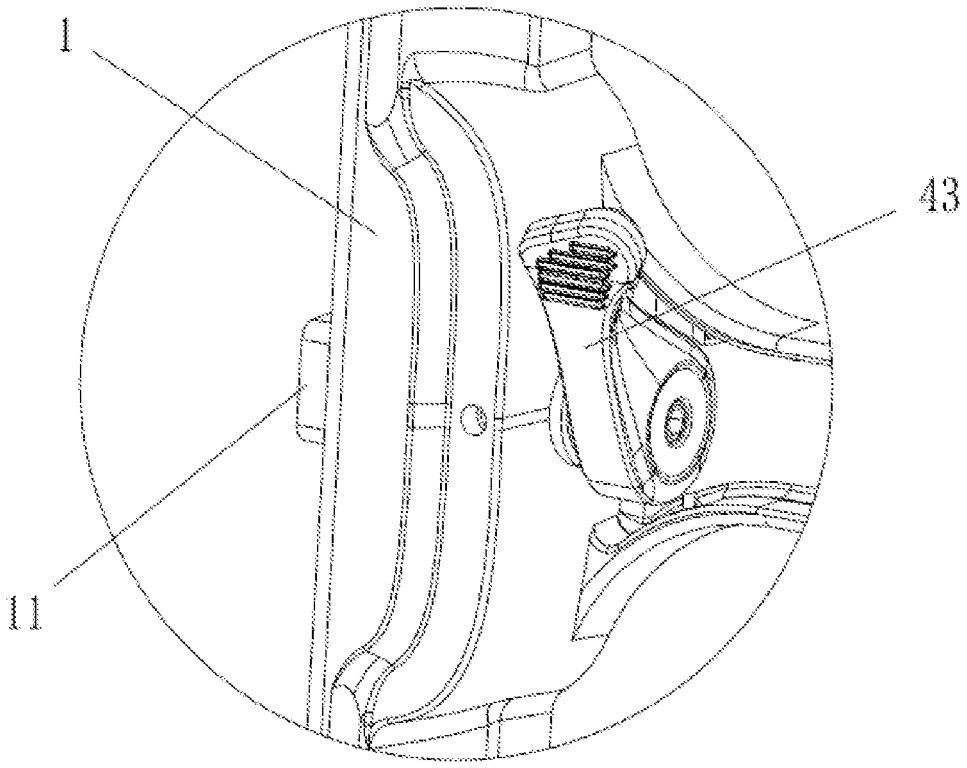
FIG. 6 is an enlarged schematic view of part B of FIG. 2.

In some embodiments, an angle indicator point 321 is provided on the knob 32. Correspondingly, a circle of angular digital marks 221 (as illustrated in FIG. 5) is provided on the front side plate 22 around the knob 32.

Figure 4:
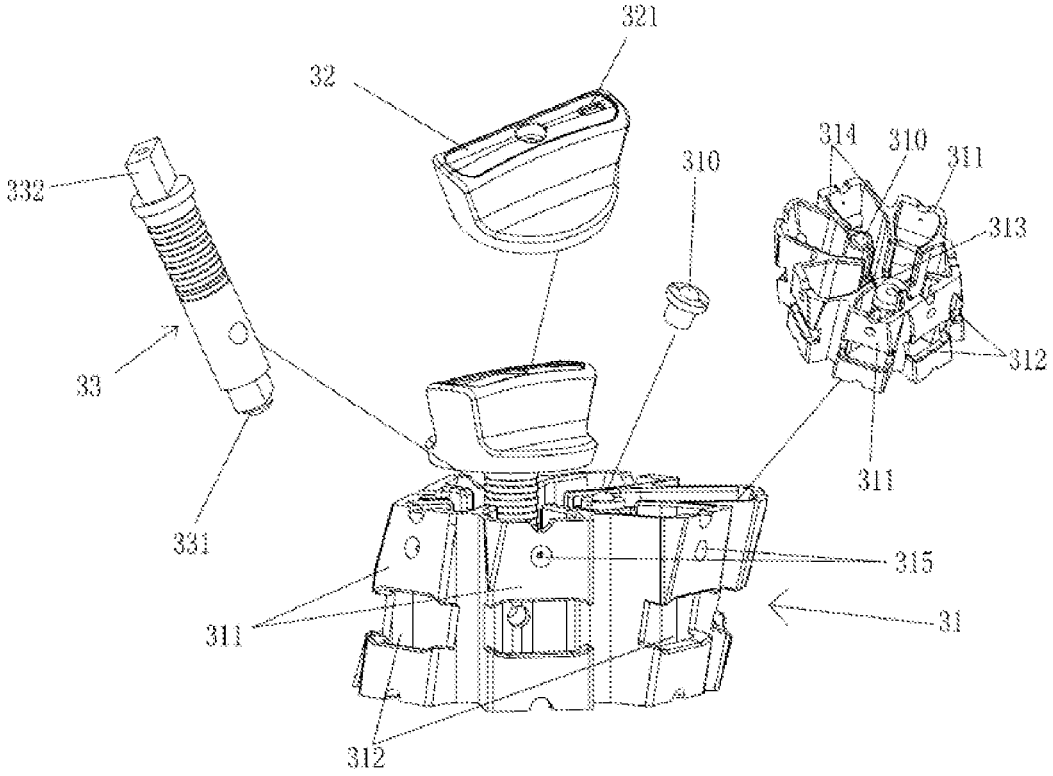
FIG. 4 is an enlarged schematic view of an arc-shaped lock mechanism of an LED display screen in accordance with an embodiment of the present disclosure.
Figure 9:
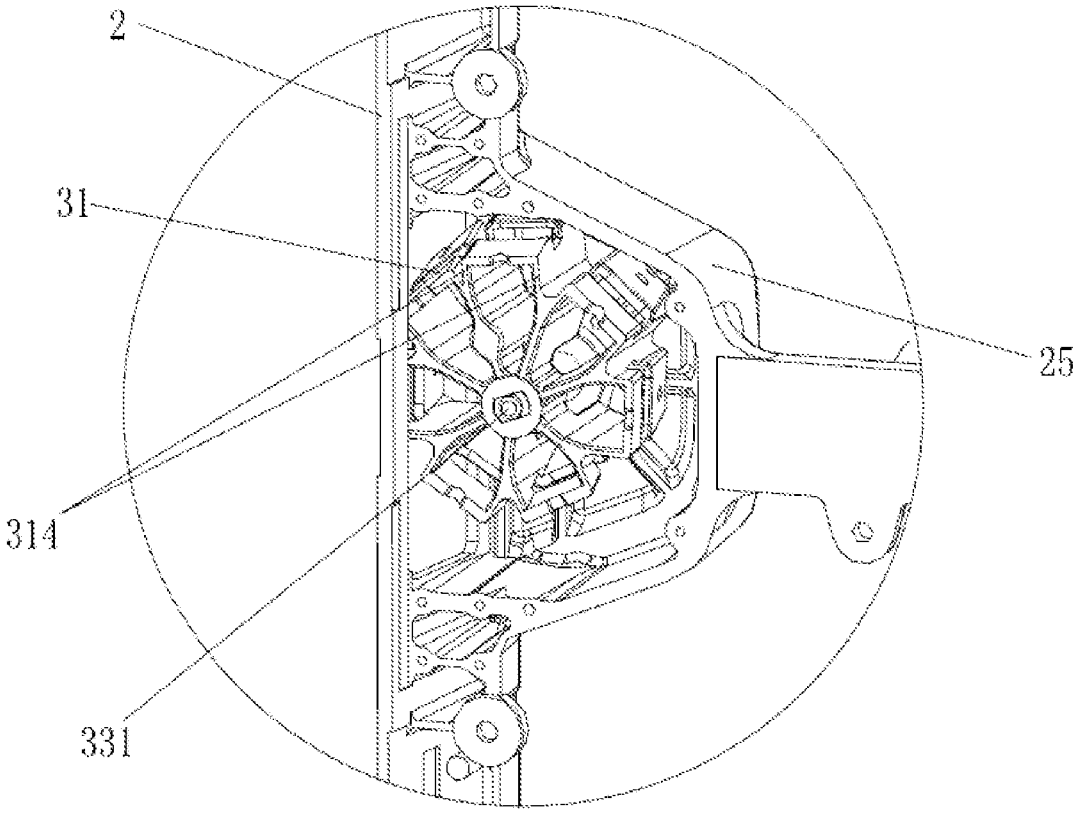
FIG. 9 is an enlarged schematic view of part C of FIG. 3.
Figure 10:
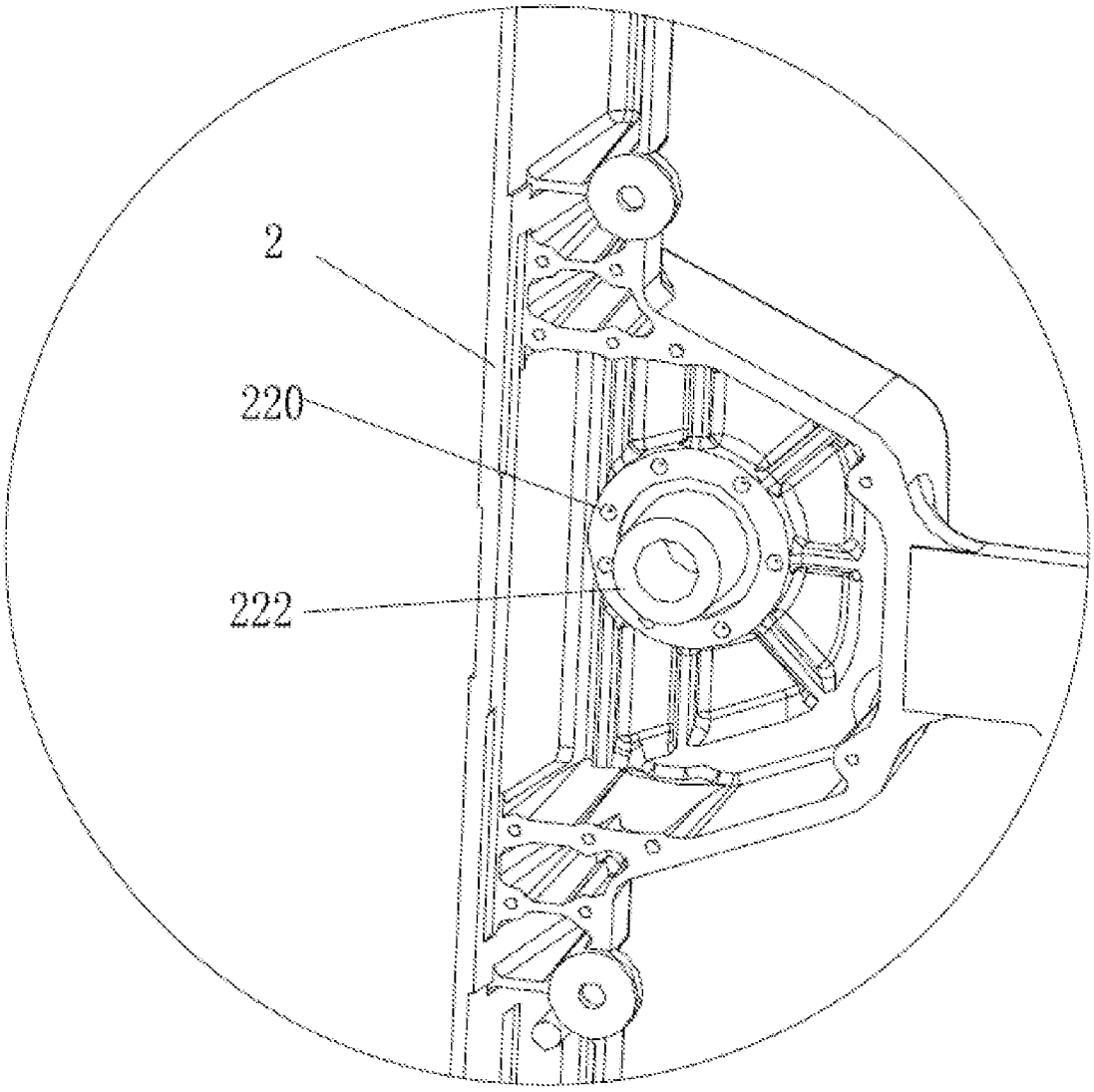
FIG. 10 is an enlarged schematic view of FIG. 9 with the rotating block removed.
Figure 11:
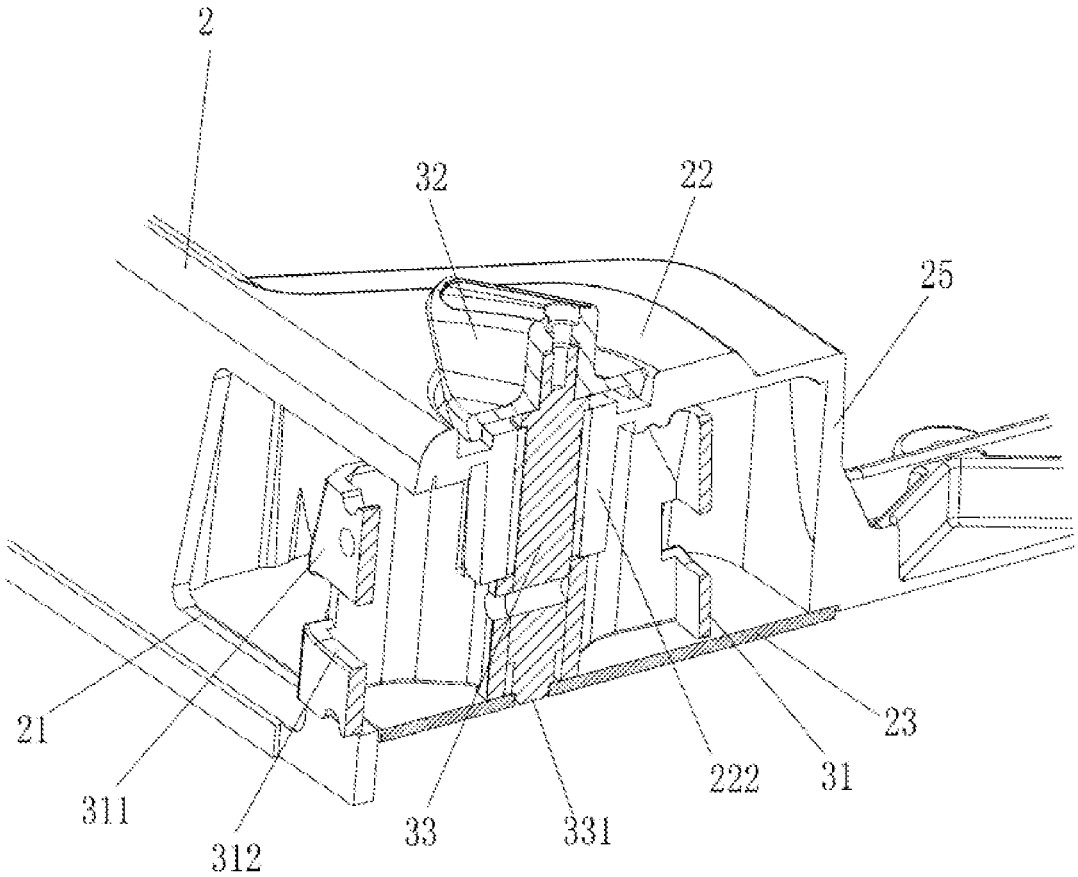
FIG. 11 is an enlarged cross-sectional view of an arc-shaped lock mechanism of an LED display screen in accordance with an embodiment of the present disclosure.

In connection also with FIG. 4 as well as FIGS. 9 to 11, in some embodiments the arc-shaped locking mechanism 3 further includes a rotating shaft 33. The upper end of the rotating shaft 33 passes through the front side plate 22 to be fixedly connected to the middle of the knob 32, while the lower side of the rotating shaft 33 is fixedly connected to the rotating block 31. In some embodiments, a circular mating hole 231 may be defined in the rear enclosure plate 23, while a corresponding circular limiting step 331 may be arranged at the lower end of the rotating shaft 33. The circular limiting step 331 at the lower end of the rotating shaft 33 passes downwardly through the rotating block 31 and is then relatively rotatably inserted into the circular mating hole 231. Thus, when the knob 32 is rotated driving the rotating block 31 also to rotate, the circular limiting step 331 would keep rotating within the circular mating hole 231. As such, the rotary block 31 can be ensured to only rotate but not move left or right when the knob 32 is rotating.

In some embodiments, in order to better secure the rotating shaft 33 and the knob 32 relative to each other, the upper end of the rotating shaft 33 is shaped as a cuboid 332. Correspondingly, a cuboid hole (not shown) is also defined in the middle of the knob 32. The cuboid 332 of the rotating shaft 33 is inserted into the cuboid hole in the knob 32, and then the knob 32 and the rotating shaft 33 are locked by a countersunk screw.

In some embodiments, the rotating block 31 includes a middle portion 313, and a plurality of groups of extension plates 314 extending outwardly from the middle portion 313. Each group of extension plates 314 is arranged as two extension plates spaced apart from each other. The outer end of each group of extension plates 314 is connected to one of the plurality of inclined plates 311 so that there would be enclosed a certain space between the inclined plate 311, the group of extension plates 314 connected to this inclined plate 311, and the middle portion 313 of the rotating block 31. The inverted double-D-shaped lock head 44 can be inserted into the rotating block 31 of the adjacent frame 100, i.e., into the enclosed space, through the inverted double-D-shaped lock hole 312 of each of the plurality of inclined plates 311 of the rotating block 31 of the adjacent frame 100.

In some embodiments, the front end surface of the middle portion 313 of the rotating block 31 is lower than the front end surface of the extension plates 314. Correspondingly, a protruding post 222 is arranged on the inner end of front plate 22 and extends backward from the middle portion 313 of the inner end. Thus, after the arc-shaped locking mechanism 3 is assembled, the front end surface of the middle portion 313 of the rotating block 31 would abut against the rear end surface of the protruding post 222, while the front end surface of the extension plates 314 would abut against the inner end surface of the front side plate 22, and the rear end surface of the rotating block 31 would be in contact with the inner end surface of the rear enclosure plate 23. As such, the rotating block 31 cannot move back and forth relative to the front side plate 22 and the rear enclosure plate 23.

In some embodiments, connection holes (not shown) that extend forward and backward are defined in both the center of the protruding post 222 and the center of the middle portion 313 of the rotating block 31. The upper end of the rotating shaft 33 passes upward through the connection hole in the center of the protruding post 222 to be fixedly connected to the knob 32, while the lower side of the rotating shaft 33 inserts downward into the connection hole in the center of the middle portion 313 of the rotating block 31. Thus, the circular limiting step 331 at the lower end of the rotating shaft 33 passes through the connection hole in the center of the middle portion 313 of the rotating block 31 to be inserted into the circular mating hole 231 in the rear enclosure plate 23. The rotating shaft 33 and the middle portion 313 of the rotating block 31 can then be fixedly connected by a known fastening member such as a screw. Therefore, the knob 32 and the rotating block 31 are fixedly connected to each other through the rotating shaft 33.

In some embodiments, in order to better protect the rotating block 31, the frame 100 further includes an outer plate 25 connected between the front side plate 22 and the rear enclosure plate 23. Thus, the rotating block 31 would be located in the space surrounded by the front side plate 22, the rear enclosure plate 23, and the outer plate 25. The plurality of inclined plates 311 of the rotating block 31 would therefore face the oblique boss 11 of the adjacent frame 100 through the through hole 21 in the right side plate 2 of the frame 100. In some embodiments, the front side plate 22, the outer plate 25, and the right side plate 2 are integrally formed with each other, while the rear enclosure plate 23 is fixedly connected to the rear end of the outer plate 25 by means of a screw or a snap mechanism. Such an arrangement has the advantage that the rear enclosure plate 23 is removable facilitating the assembly of the frame 100 with the arc-shaped locking mechanism 3.

Because the lock lever 42 is threadedly connected with the sleeve 41, when the handle 43 is rotated the lock lever 42 would not only move left and right relative to the sleeve 41 but would also rotate at the same time so that the inverted double-D-shaped lock head 44 would also rotate accordingly. When the handle 43 is rotated to a certain angle in one direction, the lock head would. as the lock lever 42 moves, retract into the through hole 10 in the left side plate 1 of the frame 100, so that the inverted double-D-shaped lock head 44 can be protected from being damaged in the frame 100 during storage and transportation.

To assemble two frames 100 (for ease of description, the two frames 100 will be hereinafter referred to as the first frame and the second frame), because the angle of the oblique boss 11 stays unchanged, the inclined plate 311 of the rotating block 31 that has an appropriate tilt angle would need to be chosen based on the LED display screen shape requirements to engage with the oblique boss 11. The choice can be made in the following manner. For example, if the LED display screen needs to be a planar configuration, which indicates that the angle between the two frames 100 after they are assembled needs to be 0, then the knob 32 can be rotated continually until the angle indicator point 321 thereon points to the angular digital mark of 10 degrees; at this point, the knob 32 is rotated in place. While during the rotating process of the knob 32, the rotating block 31 would also rotate accordingly so that when the knob 32 is rotated in place, the inclined plate 311 on the rotating block 31 with the corresponding tilt angle would be rotated to face the oblique boss 11 of the second frame. At this point, the handle 43 on the second frame is rotated to drive the lock lever 42 to move in the direction of the first frame, and the inverted double-D-shaped lock head 44 is rotated to be parallel with the inverted double-D-shaped lock hole 312 in the inclined plate 311 with the corresponding tilt angle. Then the second frame is pushed, so that the inverted double-D-shaped lock head 44 of the second frame is inserted into the rotating block 31 of the first frame through the inverted double-D-shaped lock hole 312 in the rotating block of the first frame, and that the oblique boss 11 of the second frame would abut against the inclined plate 311 having the corresponding tilt angle of the rotating block 31 of the first frame. After the inclined plate 311 sticks with the oblique boss 11, the right side plate 2 of the first frame and the left side plate 1 of the second frame would also completely fit together. That is, the two frames 100 lie in the same plane, which means they are assembled into a planar configuration. At this point, the handle 43 can be rotated continually in the reverse direction so that the lock lever 42 is moved in the opposite direction until the inverted double-D-shaped lock head 44 abuts on the inner side of the inclined plate 311 with the corresponding tilt angle and is no longer parallel with the inverted double-D-shaped lock hole 312 of this inclined plate 311. Thus, the inverted double-D-shaped lock head 44 cannot be pulled out from the inverted double-D-shaped lock hole 312. Therefore, the two frames 100 can be firmly locked and assembled together, and the two frames 100 lie in the same plane after they are assembled and so the LED display is in a planar shape.

If the assembled LED display screen needs to be curve-shaped and the angle between the two frames 100 after they are assembled is required to be 15 degrees, then the knob 32 can be rotated continually until the angle indicator point 321 thereon is aligned with the angular digital mark that represents 15 degrees. At this time, as the knob 32 is rotated in position, the inclined plate 311 on the rotating block 31 having another corresponding tilt angle would also be rotated in an orientation that faces the oblique boss 11 of the second frame, and the inclined plate 311 can be moved to stick with and abut against the oblique boss 11 of the second frame. As such, the two frames 100 would make an angle of 15 degrees after they are assembled and locked. Likewise, if other angles are required, the knob 32 needs only to be rotated to make the angle indicator point 321 thereon point to the corresponding angular digital mark 221 such that the inclined plate 311 on the rotating block that has the corresponding tilt angle would be rotated to the corresponding position and engage with the oblique boss 11 of the second frame, and so the two frames 100 would make a corresponding angle after they are assembled.

As described supra, because the rotating block 31 in accordance with the present disclosure is provided with a plurality of inclined plates 311 having different tilt angles, different inclined plates 311 can respectively be engaged with the oblique boss 11 of the other frame 100 so that the two frames 100 will form different angles after they are assembled. Thus, the frames 100 of the LED display screen according to this disclosure can not only be assembled into a planar configuration but they can also be assembled into angular configurations. That is, the LED display screen in accordance with this disclosure can not only be assembled as a planar shape, but it can be assembled as a curved shape, and can further be assembled into curved shapes having different curvatures with superior assembling effects. In other words, the frames provided by the present disclosure can implement a variety of assembling modes, so that LED display screens of different shapes can be assembled by using the frames 100 provided herein; that is, the frame 100 provided herein has versatility and can thus greatly reduce the cost. In addition, because the knob 32 is provided with the angle indicator point 321 while the front plate 22 is provided with the corresponding angular digital marks 221, in actual assembling the knob 32 needs only to be directly rotated to make the angle indicator point 321 align with the desired angular digital mark 221, which is particularly intuitive, so that the angle adjustment is particularly simple and convenient, and the operation difficulty in assembling is greatly reduced. Furthermore, the structural arrangement of the quick locking mechanism 4 also makes it easier and faster to lock the two frames 100 together.

In some embodiments, a first elastic bead 310 is arranged on the upper end surface of the rotating block 31. Correspondingly, a plurality of first positioning holes 220 corresponding to the number of the inclined plates 311 of the rotating block are defined in the lower end surface of the front side plate 22 in an annular array. Through the cooperation of the first elastic bead 310 and the first positioning holes 220, the rotating block 31, the knob 32, and the frame 100 can be better positioned relative to each other after rotating the knob 32.

In some embodiments, a second elastic bead 110 is arranged on the oblique boss 11. Correspondingly, a second positioning hole 315 configured to engage with the second elastic bead 110 and facilitate the positioning is arranged on each of the plurality of inclined plates 311 of the rotating block 31. Through the cooperation of the second elastic bead 110 and the second positioning holes 315, two adjacent frames 100 can be better positioned facilitating the assembling and locking of the two frames 100.

When the two frames 100 are to be disassembled, again the handle 43 needs only to be rotated such that the lock lever 42 would be rotated and moved and the inverted double-D-shaped lock head 44 would no longer stick with the inner side of the inclined plate 311. When the handle 43 is rotated to a certain angle, the inverted double-D-shaped lock head 44 would again be parallel with the inverted double-D-shaped lock hole 312, and the two frames 100 can be directly separated from each other. In this manner, the frames 100 in accordance with this disclosure can be conveniently and quickly assembled and disassembled.

In some embodiments, it is provided that each time the handle 43 is rotated it needs only to be rotated 90 degrees. That is, when the handle 43 is rotated 90 degrees in one direction, the inverted double-D-shaped lock head 44 would be parallel with the inverted double-D-shaped lock hole 312, and the inverted double-D-shaped lock head 44 would be moved away from the oblique boss 11 by a certain distance which ensures that inverted double-D-shaped lock head 44 can be inserted into the rotating block 31 through the inverted double-D-shaped lock hole 312. When the two frames 100 are to be locked, the handle 43 is rotated 90 degrees in the opposite direction so that the inverted double-D-shaped lock head 44 moves as the lock lever 42 moves and then abuts on the inner side of the inclined plate 311 and orients perpendicular to the inverted double-D-shaped lock hole 312. At this point, the two frames 100 are locked and thus assembled together.

In other embodiments, the rotating block 31 may include a plurality of inclined plates, a front plate connected to the front end of the plurality of inclined plates, and a rear plate connected to the rear end of the plurality of inclined plates. Thus, a hollow space is enclosed between the front plate, the rear plate, and the plurality of inclined plates. The rotating block of such an arrangement can be connected to the knob 32, the front side plate 22, and the rear enclosure plate 23 by any publicly known and workable connection method, as long as the connection does not affect the rotation of the rotating block 31 and the knob 32. That is, the specific shape of the rotating block 31 is not limited, and the specific fixed connection method for connecting the rotating block 31 and the knob 32 is also not limited, as long as the knob 32 and the rotating block 31 are fixedly connected and a plurality of inclined plates 311 with different inclinations are arranged on the periphery of the rotating block 31.

It should be understood that, although in some embodiments the lock hole and the lock head are both configured as an inverted double-D shape, in other embodiments the lock hole and the lock head can also be provided in other suitable shapes such as a rectangle 332, etc., as long as it can serve the function as the inverted double-D shape.

Figure 2:
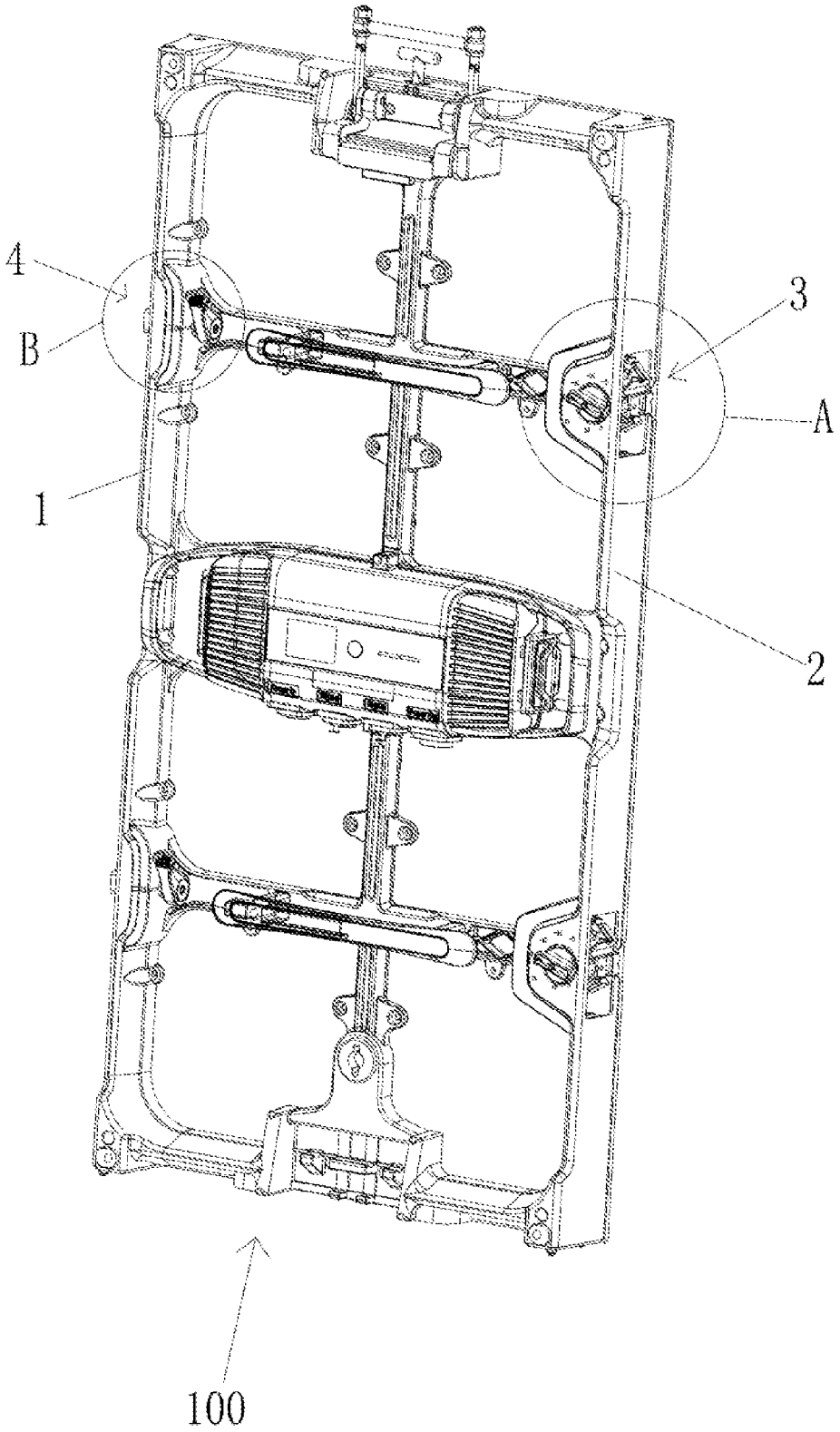
FIG. 2 is a front perspective view of a frame of an LED display screen in accordance with an embodiment of the present disclosure.
Figure 3:
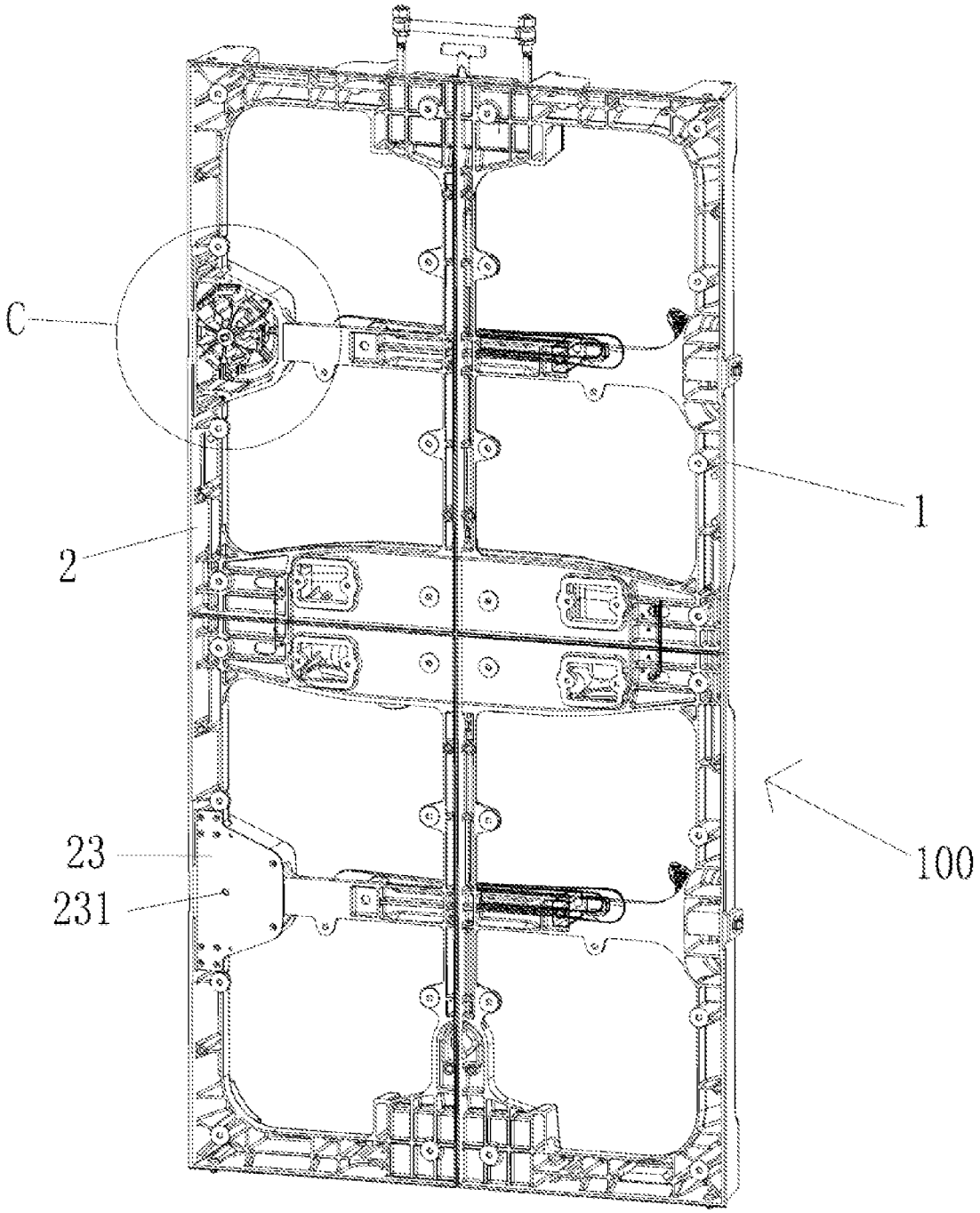
FIG. 3 is a rear perspective view of a frame of an LED display screen in accordance with an embodiment of the present disclosure.

Note, the foregoing description takes the orientation of FIG. 2 as the reference, the position where the quick locking mechanism 4 is located is taken as the left, the position of the arc-shaped locking mechanism 3 is taken as the right, the position of the front side plate is taken as the front, and the position of the rear enclosure plate taken as the rear.

What is claimed is:

1. A light emitting diode display screen operative to implement a plurality of assembling modes, comprising two or more frames, wherein each frame comprises:

a left side plate, comprising an oblique boss disposed on a left end surface of the left side plate;

a right side plate, wherein a through hole extending leftward and rightward is provided in the right side plate, and a front side plate and a rear enclosure plate are respectively disposed on front and rear sides to the left of the right side plate, wherein the space between the front side plate and the rear enclosure plate communicates with the through hole;

an arc-shaped locking mechanism, disposed on the right side of the frame and comprising a rotating block disposed between the front side plate and the rear enclosure plate; a knob disposed outside a front end of the front side plate and fixedly connected to the rotating block; and a plurality of inclined plates having different tilt angles disposed on an outer ring of the rotating block; wherein the oblique boss of one of the frames is operative to stick with and abut against different inclined plates of the rotating block of an adjacent frame, respectively; and a quick locking mechanism configured to firmly connect the two adjacent frames.

2. The light emitting diode display screen according to claim 1, wherein a second through hole extending leftward and rightward is provided in the left side plate of the frame and penetrates through the oblique boss, and an inverted double-D-shaped lock hole is provided in the middle of each of the plurality of inclined plates of the rotating block; wherein the quick locking mechanism comprises a sleeve and a lock lever that extend leftward and rightward and a handle fixedly connected to a right end of the lock lever, wherein the sleeve is fixedly connected within the second through hole, the lock lever is inserted through the sleeve and threadedly connected to the sleeve, and the handle is disposed on the right side of the left side plate; and wherein an inverted double-D-shaped lock head corresponding to the shape of the inverted double-D-shaped lock hole is disposed at a left end of the lock lever, and is operative to insert through the inverted double-D-shaped lock hole in each of the plurality of inclined plates of the rotating block of the adjacent frame into the rotating block of the adjacent frame.

3. The light emitting diode display screen according to claim 2, wherein an angle indicator point is provided on the knob, and correspondingly a circle of angular digital marks is provided on the front side plate around the knob.

4. The light emitting diode display screen according to claim 1, wherein the arc-shaped locking mechanism further comprises a rotating shaft, wherein an upper end of the rotating shaft penetrates through the front side plate to be fixedly connected to a middle portion of the knob, and a lower side of the rotating shaft is fixedly connected to the rotating block; a circular mating hole is provided in the rear enclosure plate and a corresponding circular limiting step is disposed at a lower end of the rotating shaft, wherein the circular limiting step at the lower end of the rotating shaft passes downward through the rotating block and is rotatably inserted into the circular mating hole.

5. The light emitting diode display screen according to claim 4, wherein the rotating block further comprises a middle portion and a plurality of groups of extension plates extending outwardly from the middle portion, wherein each group of the plurality of groups of extension plates is arranged as two extension plates spaced apart from each other, and an outer end of each group of the plurality of groups of extension plates is connected to one of the plurality of inclined plates so that there is enclosed a space between the inclined plate, the group of extension plates connected to the inclined plate, and the middle portion of the rotating block; and the inverted double-D-shaped lock head is operative to insert through the inverted double-D-shaped lock hole of each of the plurality of inclined plates of the rotating block of the adjacent frame into the rotating block of the adjacent frame or into the enclosed space.

6. The light emitting diode display screen according to claim 5, wherein a front end surface of the middle portion of the rotating block is lower than a front end surface of the extension plates, and a protruding post is arranged on an inner end of the front side plate and extends backward from the center of the inner end; wherein after the arc-shaped locking mechanism is assembled, a front end surface of the middle portion of the rotating block abuts against a rear end surface of the protruding post, a front end surface of the extension plates abuts against an inner end surface of the front side plate, and a rear end surface of the rotating block is in contact with an inner end surface of the rear enclosure plate.

7. The light emitting diode display screen according to claim 6, wherein connection holes extending forward and backward are provided at both the center of the protruding post and the center of the middle portion of the rotating block; the upper end of the rotating shaft passes upward through the connection hole in the center of the protruding post to be fixedly connected to the knob, and the lower side of the rotating shaft inserts downward into the connection hole in the center of the middle portion of the rotating block; the circular limiting step at the lower end of the rotating shaft passes through the connection hole in the center of the middle portion of the rotating block to be inserted into the circular mating hole in the rear enclosure plate; and the rotating shaft is fixedly connected with the middle portion of the rotating block.

8. The light emitting diode display screen according to claim 4, wherein the rotating block comprises a plurality of inclined plates, a front plate connected to a front end of the plurality of inclined plates, and a rear plate connected to a rear end of the plurality of inclined plates, and wherein a hollow space is enclosed between the front plate, the rear plate, and the plurality of inclined plates.

9. The light emitting diode display screen according to claim 1, wherein a first elastic bead is arranged on an upper end surface of the rotating block, and a plurality of first positioning holes corresponding to the number of the inclined plates of the rotating block are provided in a lower end surface of the front side plate in an annular array.

10. The light emitting diode display screen according to claim 9, wherein a second elastic bead is arranged on the oblique boss, and correspondingly a second positioning hole is provided in each of the plurality of inclined plates of the rotating block and is configured to engage with the second elastic bead and facilitate the positioning.

11. The light emitting diode display screen according to claim 2, wherein the arc-shaped locking mechanism further comprises a rotating shaft, wherein an upper end of the rotating shaft penetrates through the front side plate to be fixedly connected to a middle portion of the knob, and a lower side of the rotating shaft is fixedly connected to the rotating block; a circular mating hole is provided in the rear enclosure plate and a corresponding circular limiting step is disposed at a lower end of the rotating shaft, wherein the circular limiting step at the lower end of the rotating shaft passes downward through the rotating block and is rotatably inserted into the circular mating hole.

12. The light emitting diode display screen according to claim 3, wherein the arc-shaped locking mechanism further comprises a rotating shaft, wherein an upper end of the rotating shaft penetrates through the front side plate to be fixedly connected to a middle portion of the knob, and a lower side of the rotating shaft is fixedly connected to the rotating block; a circular mating hole is provided in the rear enclosure plate and a corresponding circular limiting step is disposed at a lower end of the rotating shaft, wherein the circular limiting step at the lower end of the rotating shaft passes downward through the rotating block and is rotatably inserted into the circular mating hole.

13. The light emitting diode display screen according to claim 2, wherein a first elastic bead is arranged on an upper end surface of the rotating block, and a plurality of first positioning holes corresponding to the number of the inclined plates of the rotating block are provided in a lower end surface of the front side plate in an annular array.

14. The light emitting diode display screen according to claim 3, wherein a first elastic bead is arranged on an upper end surface of the rotating block, and a plurality of first positioning holes corresponding to the number of the inclined plates of the rotating block are provided in a lower end surface of the front side plate in an annular array.

15. The light emitting diode display screen according to claim 4, wherein a first elastic bead is arranged on an upper end surface of the rotating block, and a plurality of first positioning holes corresponding to the number of the inclined plates of the rotating block are provided in a lower end surface of the front side plate in an annular array.

16. The light emitting diode display screen according to claim 5, wherein a first elastic bead is arranged on an upper end surface of the rotating block, and a plurality of first positioning holes corresponding to the number of the inclined plates of the rotating block are provided in a lower end surface of the front side plate in an annular array.

17. The light emitting diode display screen according to claim 6, wherein a first elastic bead is arranged on an upper end surface of the rotating block, and a plurality of first positioning holes corresponding to the number of the inclined plates of the rotating block are provided in a lower end surface of the front side plate in an annular array.

18. The light emitting diode display screen according to claim 7, wherein a first elastic bead is arranged on an upper end surface of the rotating block, and a plurality of first positioning holes corresponding to the number of the inclined plates of the rotating block are provided in a lower end surface of the front side plate in an annular array.

19. The light emitting diode display screen according to claim 8, wherein a first elastic bead is arranged on an upper end surface of the rotating block, and a plurality of first positioning holes corresponding to the number of the inclined plates of the rotating block are provided in a lower end surface of the front side plate in an annular array.

* * * * *